United States Patent [19]

Tallon

[11] 4,046,260

[45] Sept. 6, 1977

[54] DISPLAY STAND

[75] Inventor: James I. Tallon, Cuyahoga Falls, Ohio

[73] Assignee: McNeil Corporation, Akron, Ohio

[21] Appl. No.: 580,923

[22] Filed: May 27, 1975

[51] Int. Cl.[2] ..... A47F 5/13

[52] U.S. Cl. ..... 211/24; 211/195; 248/166; 248/175; 248/464

[58] Field of Search ..... 211/20–24, 211/41, 177, 178, 181, 195, 198, 199; 248/165, 166, 174, 175, 176, 118, 188, 188.1, 188.7, 188.6, 460, 472, 127, 80, 462–464, 528

[56] References Cited

U.S. PATENT DOCUMENTS

| | | | |
|---|---|---|---|
| 1,722,521 | 7/1929 | Hiatt | 248/153 |
| 2,035,288 | 3/1936 | Aughtry | 211/24 |
| 3,109,618 | 11/1963 | Saunders | 248/464 |
| 3,305,201 | 2/1967 | Thiel | 248/167 X |
| 3,369,787 | 2/1968 | Dasta et al. | 248/118 |

FOREIGN PATENT DOCUMENTS

| | | | |
|---|---|---|---|
| 1,368,091 | 6/1964 | France | 248/176 |
| 444,804 | 2/1968 | Switzerland | 211/178 R |
| 911,702 | 11/1962 | United Kingdom | 211/178 R |
| 1,144,666 | 3/1969 | United Kingdom | 211/178 R |
| 256,863 | 8/1926 | United Kingdom | 211/178 R |

*Primary Examiner*—Roy D. Frazier
*Assistant Examiner*—Terrell P. Lewis
*Attorney, Agent, or Firm*—Hamilton, Renner & Kenner

[57] ABSTRACT

A display stand for generally toroidal articles capable of being folded into a single plane for convenient storage or transporting having two sides, with a first side member being formed as an integral enclosed wire loop and the other side member being similarly configured and pivotally attached to form a hinge about a common leg with the first side member, base legs of the sides which engage a resting surface for the display stand, riser posts incorporated in the sides to vertically displace the article to be displayed up off of the resting surface, carriage arms formed in the sides at a convenient angle for visual observation of the displayed article, dogleg offsets in the arms which engage the article to insure its retention, and a crossbar for locking the sides in spaced relation and forming a generally triangular resting zone for the article to be displayed.

10 Claims, 3 Drawing Figures

DISPLAY STAND

BACKGROUND OF THE INVENTION

The invention relates to a display stand for displaying tires or other articles of generally toroidal configuration or a portion thereof. More particularly, the invention relates to a display stand having two side members which fold into a plane for storage or transporting and are positively locked in an erected position, constituting a generally pyramidal configuration, by a hook and eye-type crossbar which also acts as part of the roughly triangular resting zone for an article to be displayed. More specifically the configuration of the side members includes, base legs which substantially engage a floor or resting surface for the stand, riser posts to hold the article up off of the floor, carriage arms which with a crossbar form the resting zone for the tire or article, and dogleg offsets on the carriage arms to engage the article.

There are a number of types of stands for tires or other generally toroidal articles which have been developed for retailing or other display purposes over the years. In general, prior art developments with respect to the display of generally toroidal articles have taken two somewhat diverse approaches. One of these approaches is represented by display stands which generally grasp a tire or other such article proximate the lower extremity thereof such as to provide a support proximate a seating surface for the article to be displayed. Exemplary prior art depicting this type of approach include U.S. Pat. Nos.:

1,252,073
1,539,519
1,640,792
1,714,023
1,717,560
1,901,475
2,100,077
3,510,007

Display stands of this type have proven to be generally not amenable to the display of articles of differing sizes. In addition, the gripping of a tire or other toroidal object solely about a lower portion when in a generally upright position tends to provide a decided lack of stability. In addition, this inherent deficiency in a stability sense virtually precludes the orientation of a displayed toroidal article in any orientation other than substantially vertically which under many circumstances severely limits the ability of an observer to fully perceive the various surfaces of an article from various positions relative thereto.

The other approach to the display of generally toroidal articles has been to suspend the displayed article in some manner about a hook or other retaining device which is in some manner positioned a distance above a floor or other seating surface. Prior art directed toward display stands for generally toroidal articles employing such an approach is exemplified by the following U.S. Pat. Nos.:

1,231,490
1,361,112
1,659,791
1,780,381
1,865,298
1,916,044
2,035,288
2,289,729

3,148,850.

Display stands of this type have generally exhibited a number of problems in commercial applications. In order to withstand the weight of certain types of toroidal articles, these stands have often employed relatively massive structures which prove to be structurally cumbersome to the extent of detracting in some instances from the displayed article. In addition, many of these devices are incapable of being collapsed or at least collapsing to an essentially planar form such that temporary storage or transportation become significant problems. In other instances, this type of device has proven to be somewhat unstable due to the characteristics of the material employed in the construction or because legs are employed which may penetrate a resting surface. Accordingly, the various prior art approaches to display stands for the suspension of generally toroidal articles has not produced a device which has achieved a broad commercial acceptance.

SUMMARY OF THE INVENTION

It is an object of the present invention to provide a display stand with such structural integrity as to be capable of displaying a range of sizes of generally toroidally configured articles, including relatively large and heavy varieties.

It is a further object of the present invention to provide a display stand which can be easily and quickly folded into a single plane, highly compact configuration for storage or shipping.

It is another object of the present invention to provide a display stand that orients a generally toroidal article at an optimum angle for viewing both a lateral face and one side of the article in a manner providing a revealing perspective.

It is a still further object of the present invention to provide a display stand that is relatively low to the ground and otherwise configured for stability to resist tipping forces.

It is a further object of the present invention to provide a display stand which is inexpensive to manufacture, is relatively unobtrusive in presenting the displayed article, and may be made of a number of materials which will last virtually indefinitely.

These and other objects of the present invention, together with the advantages thereof over the existing and prior art forms which will become apparent from the description to follow, are accomplished by the display stand hereinafter shown, described and claimed.

In general, a display stand employing the concepts of the present invention includes two side members of roughly right triangular configuration having dogleg offsets at the upper end of their hypotenuses and sharing a common supporting leg in pivotal relationship with a hook and eye-type crossbar to fix the two side members in spaced relation upon which the article to be displayed can be placed at such convenient angle as to facilitate viewing of the article. One preferred embodiment of the subject display stand is shown by way of example in the accompanying drawings without attempting to show all of the various forms and modifications in which the invention might be embodied the invention being measured by the appended claims and not by the details of the specification.

DESCRIPTION OF THE PREFERRED EMBODIMENT

Figure 2:
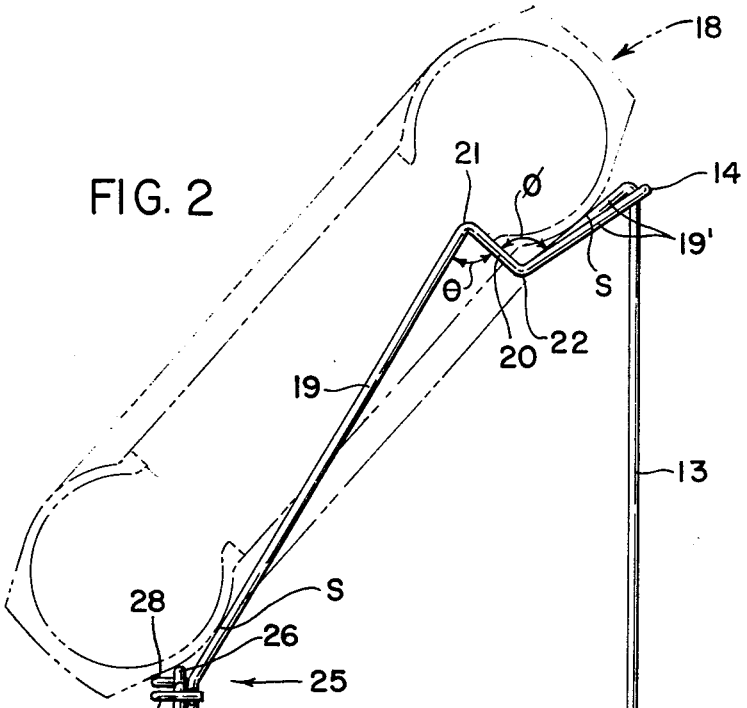
FIG. 2 is a side elevational view of the display stand of FIG. 1 with an exemplary displayed article thereon in the form of a tire depicted in section by chain lines to illustrate how the stand supports an article; and, FIG. 3 is a side elevational view of the display stand of FIG. 1 in the planar folded position as for the purposes of storage or transporting.

Referring to the drawings, a display stand according to the present invention is indicated generally by numeral 10. The display stand is preferably made of relatively rigid wire, for example approximately No. 3 gauge galvanized steel for strength, pleasing appearance, and environmental resistance or could be made of one of the many available substitute materials which would be readily apparent to persons skilled in the art. As shown, the display stand 10 has a first side member, generally indicated by the numeral 11, which is formed of an endless extent of wire lying essentially in one plane. A second side member, generally indicated by the numeral 12, has the same general configuration as the first side member 11, except that it is discontinuous, a closed planar figure being formed by joinder with a portion of first side member M constituting a common supporting leg 13. This common leg 13 shared by both side members 11 and 12 is created by means of eyes 14, at each extremity of the second side member 12, wrapped around common leg portion 13 of the first side member 11 to form a hinged or pivotal connection of the two side members 11 and 12. This connection facilitates the folding of the two side members 11 and 12 from the erected intersecting plane condition depicted in FIGS. 1 and 2 into a collapsed, single plane condition for convenient storage or transport as illustrated in FIG. 3 of the drawings.

Figure 1:
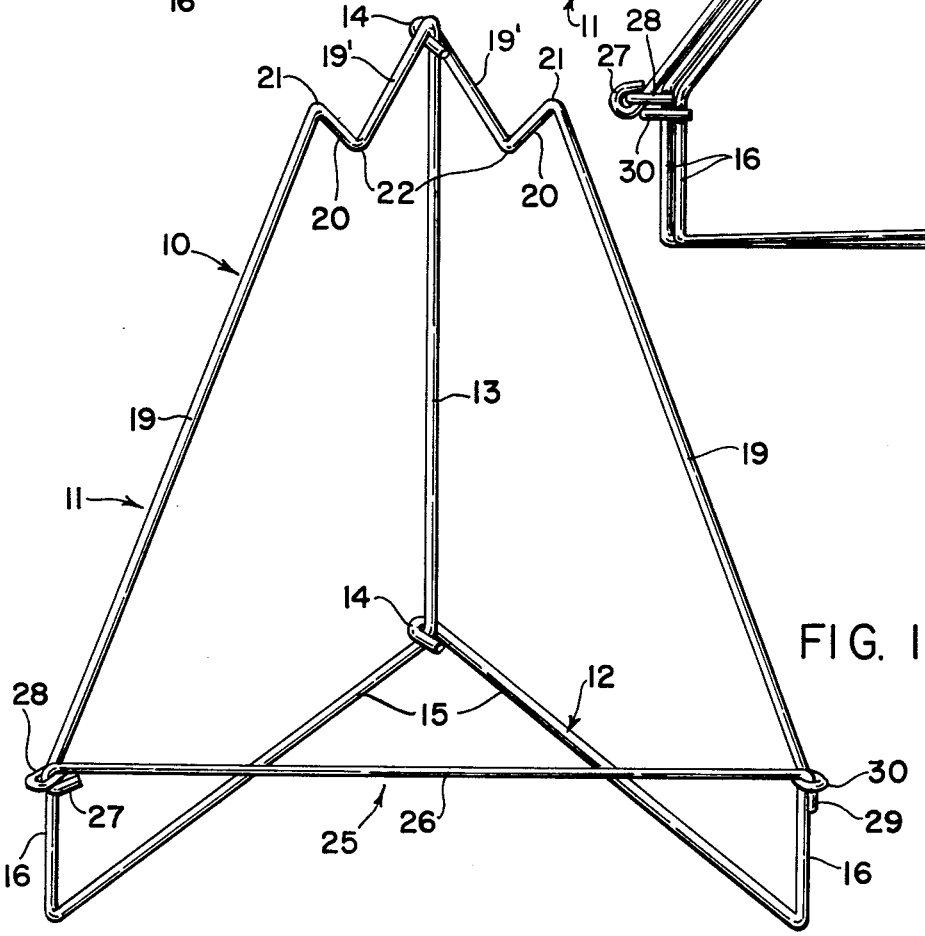
FIG. 1 is a front perspective view of a display stand embodying the concepts of the present invention in the erected position.

The configuration of the two side members 11 and 12 includes several features material to the usage of the new display stand concept presented herein. To engage a floor or other resting surface, which is normally generally planar, for support in a stable fashion each side member 11 and 12 has a base leg 15 which together form a V as they extend out from the common leg 13 when the display stand 10 is in its open position as illustrated in FIG. 1 of the drawings. With respect to the common leg 13 the bases 15 of side members 11, 12 preferably form an angle of approximately 90° or the legs of a roughly right triangle configuration. At the extreme radial end of each base 15 with respect to the common leg 13 a riser post 16 is formed to provide sufficient vertical displacement of a displayed article from a floor or resting surface as to maintain it spaced from the floor or resting surface as shown in FIG. 2, wherein a tire 18 as the displayed article is shown in broken lines to illustrate the use of display stand 10.

The ends of each riser post 16 opposite the bases 15 merge into carriage arms 19 forming roughly the hypotenuse of the above-mentioned right triangles. The carriage arms 19 are preferably at an angle of approximately 55° to the plane of the floor or resting surface for base legs 15 to present to an observer a convenient view of the various surfaces of a displayed article reposing thereon. These two carriage arms 19 form part of the support for an article to be displayed, such as tire 18.

Figure 3:
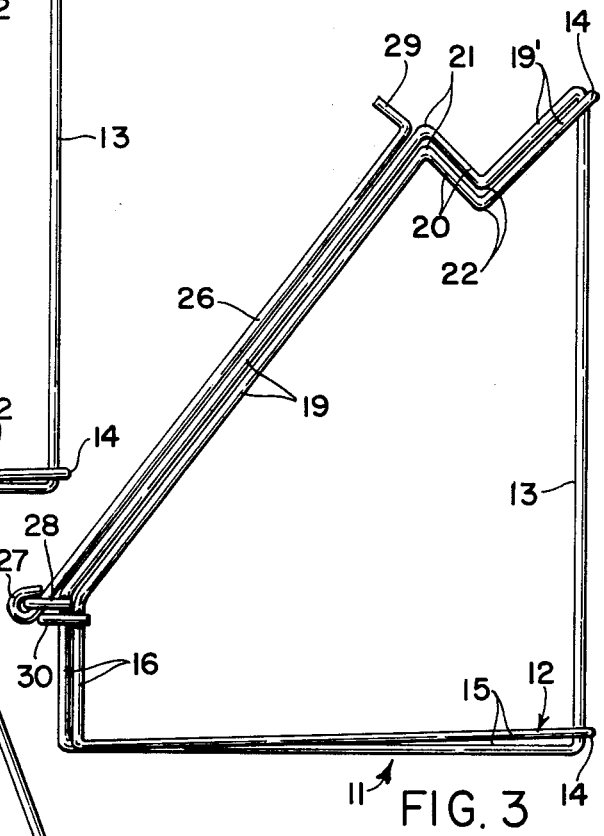

The uppermost ends of each carriage arm 19 have a dogleg offset, indicated by the numeral 20, which is for the purpose of engaging the article such that even at an angle of approximately 55° from the horizontal plane, the article such as a tire shown in FIG. 3 is securely retained in place without the need for any type of binding or other fastener engaging the tire. The dogleg offset 20 has a first bend 21 which is preferably slightly over 90° such that the angle $\theta$ (FIG. 2) between offset 20 and arm 19 of each side member 11, 12 is slightly less than 90°. This provides an angular shelf to seat the bead ring of a tire 18 to retain it on the display stand 10, the bead ring tending to displace downwardly toward a second bend 22. The second bend 22 which is preferably slightly under 90° such that the angle $\phi$ (FIG. 2) is slightly greater than 90°, thereby providing a slightly lower angular rise from the horizontal than that of the carriage arms 19. The length of offset 20 between bends 21 and 22 of side members 11, 12 is of sufficient extent to insure engagement with a sufficient portion of a substantially toroidal object such as a tire independent of differing design considerations, such as the extent of axial inset of the bead area of the tire 18 depicted in FIG. 2. The carriage arms 19 have an upper extent 19' which together with the aforementioned portions 19 engage a sidewall portion S of the tire 18 (FIG. 2).

In order to maintain display stand 10 in the erected position depicted in FIG. 1 a locking assembly, generally indicated by the numeral 25, is employed. As shown, the locking assembly has a crossbar 26 which is pivotally attached as by a loop 27 and eye 28 on side member 11. The crossbar 26 has at its extremity opposite the loop 27 a hook 29 or other fastener adapted to mate with an eye 30 on the side member 12. It is apparent that the crossbar 26 could be reversed such that the loop 27 and hook 29 engage the eyes 30 and 28, respectively. The crossbar 26 thus serves to maintain the carriage arms 19 of side members 11 and 12 spaced at a selected angularity with respect to forces tending to either reduce or increase that angularity. The freedom of movement afforded crossbar 26 by its pivotal attachment, loop 27 and eye 28, to a side member permits assumption of the collapsed, planar position of the stand 10 depicted in FIG. 3.

The eyes 28, 30 may be conveniently positioned, as shown, at approximately the transition point between riser posts 16 and carriage arms 19 of the side members 11 and 12. This positioning places the crossbar 26 in essentially a planar disposition with carriage arms 19 such that the sidewall S of tire 18 also engages the crossbar 26, thereby applying a downward force thereto tending to maintain hook 29 locked in the eye 30. Thus, the locking assembly 25 maintains the erected configuration of the stand 10 as well as providing added structural integrity to the stand such that stand 10 resists spurious forces tending to produce its tipping or collapse unless the hook 29 of crossbar 26 is intentionally detached.

Thus it should be apparent from the foregoing description of the preferred embodiment that the device herein described accomplishes the above-enumerated and other objects of the invention.

What is claimed is:

1. An erectable display stand for a generally toroidal article capable of folding into a single plane comprising:

a first side member forming an endless essentially planar configuration;

said first side member having a supporting leg;

a second side member pivotally connected to said supporting leg of said first side member;

a base leg on each of said first and second side members for engaging a resting surface for the stand when erected;

a carriage arm portion of said first and second side members disposed at an angle to said base leg of the respective of said first and second side members for supporting the article to be displayed;

a dogleg offset in said carriage arm portion of each of said side members to positively retain the article to be displayed;

riser posts on each of the said first and second side members connecting said base leg and said carriage arm portion thereof; and a locking member extending between said first and second side members to effect pivotal placement of said first side member and second side member in spaced angularity, said locking member being a crossbar which effects positive locking by hook and loop means on said crossbar and eye means on said side members at the point where said riser posts merge into said carriage arms whereby said crossbar is substantially coplanar with said carriage arms and is maintained in locking position by the article in engagement therewith.

2. An erectable display stand for a generally toroidal article capable of folding into a single plane comprising:

a first side member forming an endless essentially planar configuration;

said first side member having a supporting leg;

a second side member having two extremities pivotally connected to said supporting leg of said first side member;

a locking member extending between said first and second side members to effect pivotal placement of said first side member and said second side member in spaced angularity;

a base leg on each of said first and second side members for engaging a resting surface for the stand when erected;

a carriage arm portion of said first and second side members disposed at an angle to said base leg of the respective of said first and second side members for supporting the article to be displayed; and a dogleg offset in said carriage arm portion of each of said side members to positively retain the article to be displayed.

3. A display stand according to claim 1, further comprising eyes at the extremities of said second side member which wrap around each end of said supporting leg of said first side member to provide pivotal engagement between said side members, said supporting leg constituting a common support leg for said first and second side members.

4. A display stand according to claim 1, wherein said side members each have riser posts connected to said base legs at a point radially displaced from said supporting leg.

5. A display stand according to claim 4, wherein said carriage arms of said side members extend from said riser posts.

6. A display stand according to claim 5, wherein said carriage arms are set at an angle of approximately 55° to the plane of said base legs.

7. A display stand according to claim 5, wherein said dogleg offsets of said side members are at the uppermost ends of said carriage arms.

8. A display stand according to claim 7, wherein said dogleg offsets have a first bend of slightly over 90° from said carriage arms to form an angular shelf to seat a portion of the article to be displayed.

9. A display stand according to claim 8, wherein said dogleg offsets have a second bend resulting in a rise angle slightly less than that of said carriage arms with respect to the plane of said base legs.

10. A display stand according to claim 9, wherein an offset between said first bend and said second bend is of sufficient extent to insure substantial engagement with a toroidal object to be displayed thereon.

* * * * *